United States Patent [19]

Rapoport

[11] 4,265,286

[45] May 5, 1981

[54] ATTACHE CASE WITH REMOVABLE FILE FOLDER

[76] Inventor: George Rapoport, 644 S. Saltair, Los Angeles, Calif. 90049

[21] Appl. No.: 58,796

[22] Filed: Jul. 19, 1979

[51] Int. Cl.[3] ..... A45C 3/02

[52] U.S. Cl. ..... 150/1.6; 190/51

[58] Field of Search ..... 150/1.6, 34; 190/51

[56] References Cited

U.S. PATENT DOCUMENTS

| | | | |
|---|---|---|---|
| 1,806,246 | 5/1931 | Feldman | 190/51 |
| 1,889,765 | 12/1932 | Switkes | 190/51 |
| 3,123,190 | 3/1964 | Lifton | 190/51 |
| 3,306,405 | 2/1967 | Rosenblum | 190/51 |
| 3,352,390 | 11/1967 | Zalkind | 150/1.6 |

*Primary Examiner*—Donald F. Norton

*Attorney, Agent, or Firm*—Fulwider, Patton, Rieber, Lee & Utecht

[57] ABSTRACT

An attache case having base and lid sections and a removable file folder that is receivable within the lid. The file folder has a cover flap that closes the top end of the folder when the folder is in use separately but is folded back against the inside of the lid when the folder is used as part of the case. The folder is secured to the lid by fasteners and by two belt members attached to the lid that extend across the folder.

8 Claims, 11 Drawing Figures

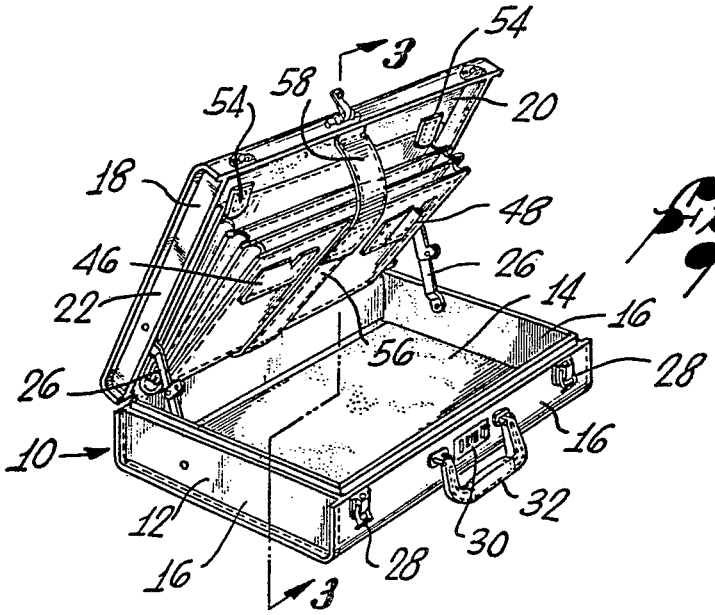
Fig. 1
Fig. 2
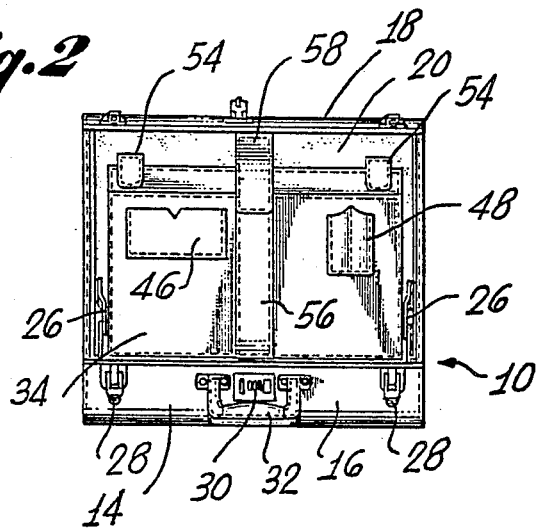
Fig. 3
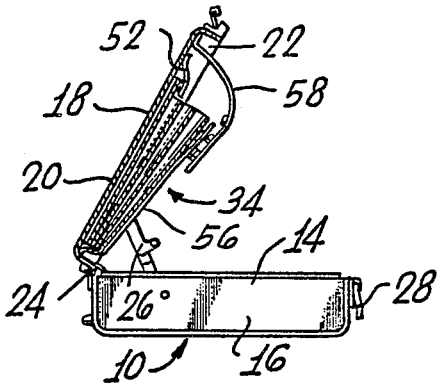
Fig. 4
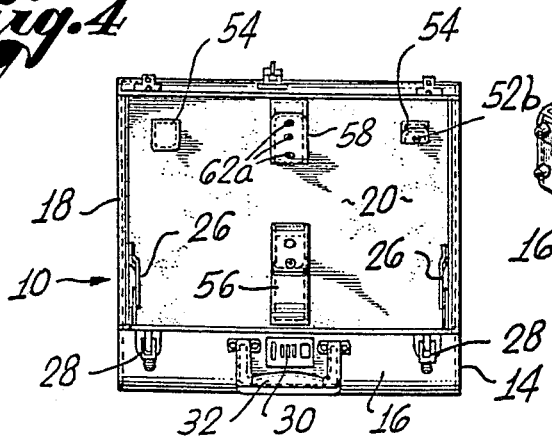
Fig. 5
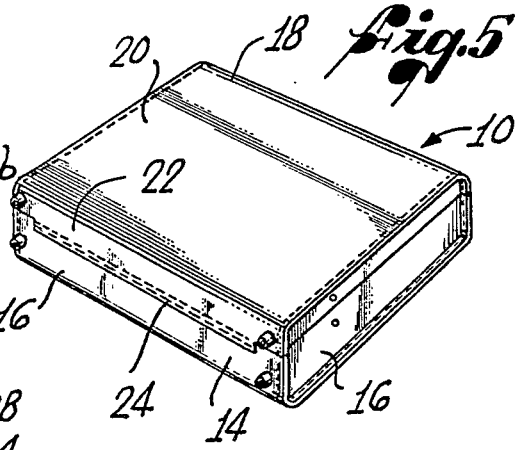

ATTACHE CASE WITH REMOVABLE FILE FOLDER

FIELD OF THE INVENTION

The present invention relates to attache cases and, more particularly, to attache cases that include removable file folders.

BACKGROUND OF THE INVENTION

It has been appreciated for some time that it is an added convenience to the user of an attache case if he is provided with a removable file folder that can be used separately. It is then possible to leave the larger case behind and carry only the folder that contains more frequently required materials. An important advantage when traveling is that the file folder can be used to hold papers and the like while the remainder of the case is available for clothing and personal articles.

If the file folder is to be used separately, it should have a cover flap in the style of conventional folders that are not used in combination with attache cases. This flap is, however, a considerable inconvenience when the folder is secured within the attache case since it prevents ready access to the interior of the file folder after the lid of the case has been raised.

A primary objective of the present invention is to provide an attache case with a removable file folder that has one or more readily accessible compartments. A further objective is to provide such a case in which the arrangement for securing the file folder makes it easy to release the folder and does not detract from the appearance of either the case or the folder.

SUMMARY OF THE INVENTION

According to the present invention, an attache case has a base section formed by a first side panel and four walls, and a lid section including a second side panel and having a closed position in which it engages the base section to form a complete enclosure. A hinge, which may be formed by a strip of flexible leather or other material, pivotably connects the lid to the base and a latch holds the lid in a closed position.

A file folder that is removably received in the lid section has an open top end and a cover flap that can be folded over the top end. When the file folder is installed in the lid, the cover flap is folded back against the inside of the second side panel so that it does not interfere with access to the interior of the file folder.

A fastener means is provided to releasably secure the folder to the lid along one edge. The fastener means includes two mating components that snap together, one component being attached to the lid while the other is attached to the folder. In addition, first and second belt members are attached to the second side panel and are connected to each other to hold the folder behind them.

In a preferred arrangement, there are two snap fasteners that secure the folder along its top edge, the lid portions of the snaps being carried by flexible tabs. The snap components attached to the folder are hidden by the flap when in its in-use position. External pockets can be provided on the folder that are exposed when it is installed in the case but covered by the flap when the folder is used separately.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a perspective view of an attache case constructed in accordance with the present invention, the case being shown with its lid in an open position;

FIG. 2 is a front elevational view with the case when open with the file folder in place;

FIG. 3 is an end view, partially in section, taken along the line 3—3 in FIG. 1;

FIG. 4 is a front elevational view with the case when open with the folder removed and the ends of the belt members turned back;

FIG. 5 is a rear perspective view of the case with the lid closed;

DESCRIPTION OF THE PREFERRED EMBODIMENT

Figure 6:
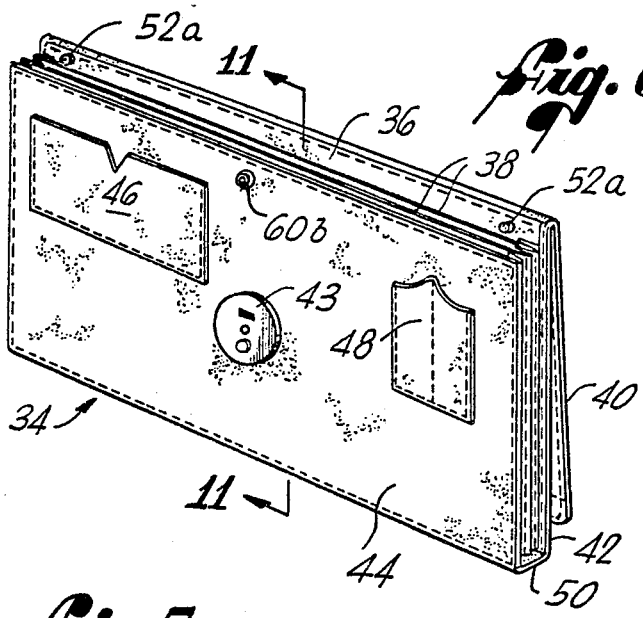
FIG. 6 is a perspective view of the file folder without the rest of the attache case.
Figure 11:
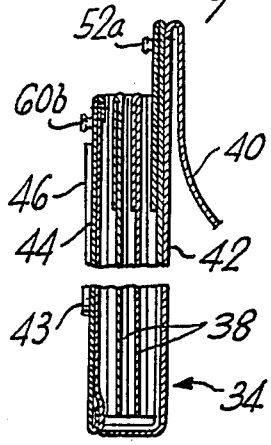
FIG. 11 is a cross-sectional view, taken along the line 11—11 of FIG. 6 to show partitions in the folder.
Figure 7:
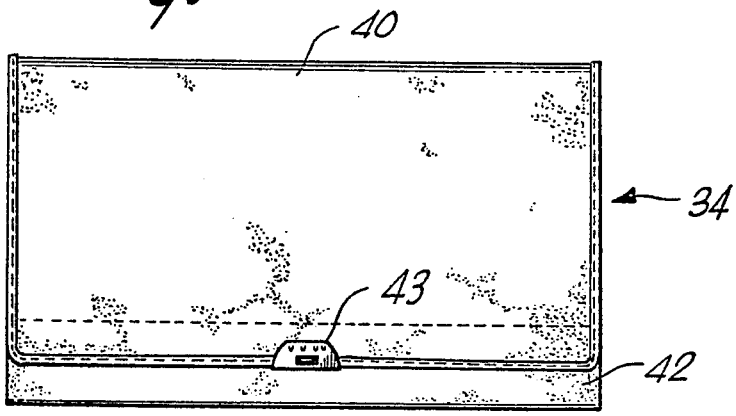
FIG. 7 is a rear elevational view of the folder with its cover flap folded back.
Figure 8:
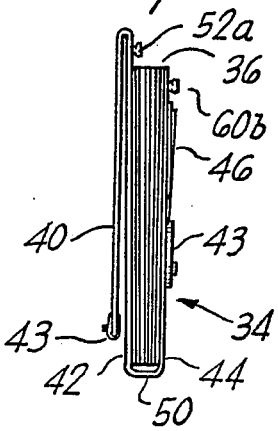
FIG. 8 is an end elevational view of the folder, taken from one side of FIG. 7, with the cover flap folded back as it is when inserted in the attache case.
Figure 9:
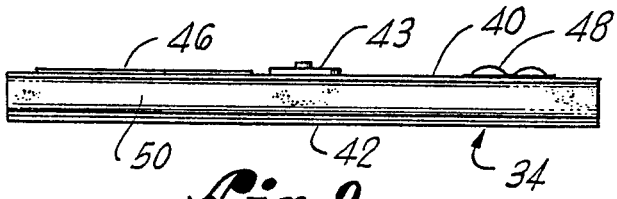
FIG. 9 is a bottom view of the folder with the flap folded back.

An attache case 10, shown in FIGS. 1–5 of the accompanying drawings, embodies the many advantages of the present invention. It includes a base section 12 having a rectangular first side panel 14 surrounded by four perpendicular walls 16. The lid section 18 includes a second rectangular side panel 20, parallel to and opposing the first side panel 14, and four narrow side walls 22. The lid 18 and base 12 combine, when their sidewalls 16 and 22 engage each other, to form an enclosed, rigid, box-like structure.

Preferably, the attache case 10 is covered with high quality leather and the lid 18 is attached to the base 12 by an elongated flexible leather strip 24 (as shown in FIG. 5) that covers as a hinge (not shown). A pair of folding brackets 26 can be locked in an extended position to hold the lid 18 open in the conventional manner. When closed, the lid 18 is secured to the base 12 along its openable edge by a pair of latches 28 and a lock 30. A handle 32 that is mounted over the lock 30 permits the case 10 to be carried conveniently.

Figure 10:
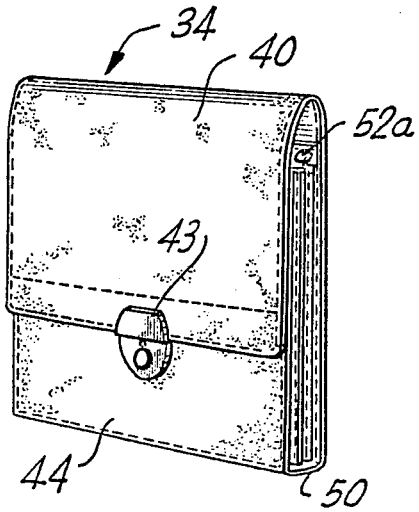
FIG. 10 is a perspective view showing the folder as it would appear when removed from the attache case for separate use.

A removable file folder 34 that forms part of the attache case 10 and is shown in FIGS. 6–11 will now be described. Preferably, it is a soft, leather, envelope-like article having an open top end 36 by which its interior compartments, separated by partitions 38, are accessible. A large, flexible, rectangular cover flap 40 is joined to a back panel 42 and can be folded over the open top end 36 to close the folder 34, as shown in FIG. 10. Alternatively, it can be folded back to expose the top end 36 as shown in FIGS. 6, 7, 8 and 11.

When folded over the top end 36, the cover flap 40 is secured by a catch 43 in a position in which it extends downwardly overlying most of a front panel 44 of the folder 34. In this position, the flap 40 covers two external pockets 46 and 48 on opposite sides of the catch 43 on the front panel 44. One of these pockets 46 is relatively wide and is suitable for holding business cards and the like. The other pocket 48 is vertically elongated and suitable for holding pens, pencils, and similar items.

The file folder 34 is removably received in the lid 18 of the attache case 10, as shown in FIGS. 1-3. The cover flap 40 is folded back in a stored position so that it lies between the back panel 42 of the holder 34 and the inside of the second side panel 20. The open top end 36 of the folder 34 faces the openable front edge of the lid 18 while the closed bottom edge 50 extends along the hinge 24.

The file folder 34 is secured to the lid 18 by a pair of fasteners 52, each including two components 52*a* and 52*b* that snap together in a conventional manner. One component 52*a* of each fastener 52 is permanently mounted on a corner of the inside of the back panel 42 of the file folder 34 where it is hidden by the cover flap 40 when the flap is in its in-use position but is exposed when the flap is in its stored position. A pair of tabs 54 carry the mating components 52*b* (which are the inner components). Each tab 54 is a flexible leather piece stitched to the inside of the secured side panel 20 (part of the lid 18) so that it can extend downwardly over the top of the back panel 42 of the folder 34.

While the fasteners 52 secure the folder 34 to the lid 18, they do not prevent it from swinging freely on the flexible tabs 54 and thus do not alone secure the folder in the most desirable manner. These fasteners 52 are, however, supplemented by two belt members 56 and 58 (see FIGS. 1-4). The lower belt member 56, is stitched to the inside of the secured side panel 20 near the center of the hinge 24 and extends around the bottom edge 50 of the folder 34 and up across its front panel 44, being secured to the front panel near its upper edge by another snap fastener 60 that has two separable components 62*a* and 62*b*. This lower belt member 56 adequately secures the file folder 34 against the second side panel 20 and can, if desired, be used alone.

The upper belt member 58 is stitched to the second side panel 20 near the openable end of the lid 18. It can be stored out of the way, between the cover flap 40 and the side panel 20. If, however, it is desired to secure the folder 34 more completely or to prevent papers placed in the compartments of the folder from coming out, the upper belt member 58 can be extended across the open top end 36 of the folder and secured, by still another snap 62, to the lower belt member 56. This snap 62 includes a plurality of inner components 62*a* mounted on the belt 58, the proper inner snap component being selected to make the belt tight or looser as desired.

It will be noted that the file folder 34 is easily and quickly installed in the lid 18 of the case 10, forming separated compartments in the lid with a larger area below in the base 12. The cover flap 40 is completely out of the way and the case 10 has the function of a more conventional product in which the compartment forming portion is not removable. Its appearance does not reveal its unique ability to form two separately usable articles. When the folder 34 is removed, the attachment provisions, which are normally hidden from view, do not interfere with the separate use of the folder and the remaining portion of the case 10.

An additional advantage of the case 10 is that when the folder 34 is removed, the belt 56, 58 can be used to hold other items such as articles of clothing. It is thus apparent that the case 10 is adaptable to many different demands of the user.

While a particular form of the invention has been illustrated and described, it will also be apparent that various modifications can be made without departing from the spirit and scope of the invention.

I claim:

1. An attache case having a base section formed by a first side panel and four walls arranged in a rectangular configuration, a lid section including a second side panel and having a closed position in which it engages said base section and combines therewith to form a complete box-like enclosure, hinge means for pivotally connecting said lid section to said base section whereby said lid section is movable between said closed position and an open position, latch means for releasably securing said lid section in said closed position, and a removable file folder with an open top end and a cover flap that can be folded over said top end in an in-use position, said file folder being receivable within said lid section with said cover flap in a stored folded-back position adjacent said lid section to expose said top edge, wherein the improvement comprises:

file folder fastener means for releasably securing said file folder to said lid section along at least one edge thereof;

a first belt member secured to said second side panel;

a second belt member secured to said second side panel; and belt fastener means for securing said first and second belt members to each other, whereby said belt members can retain said file folder within said lid section with said cover flap in said stored position.

2. The attache case of claim 1 further comprising additional fastener means for securing one of said belt members directly to said file folder, said additional fastener means having two parts one of which is permanently mounted on said file folder, said cover flap covering said part of said additional fastener means that is mounted on said file folder when in said in-use position.

3. The attache case of claim 1 wherein said file folder includes catch means for releasably securing said cover flap in said in-use position.

4. An attache case having a base section formed by a first side panel and four walls arranged in a rectangular configuration, a lid section including a second side panel and having a closed position in which it engages said base section and combines therewith to form a complete box-like enclosure, hinge means for pivotably connecting said lid section to said base section whereby said lid section is movable between said closed position and an open position, latch means for releasably securing said lid section in said closed position, and a removable file folder with an open top end and a cover flap that can be folded over said top end in an in-use position, said file folder being receivable within said lid section with said cover flap in a stored folded-back position against said lid section to expose said top end, wherein the improvement comprises:

a pair of flexible tabs each attached along one edge to the inner surface of said second side panel and extending toward said hinge means;

a pair of first fastener means for releasably securing said tabs to said file folder adjacent said top end;

a lower belt member attached to the inner surface of said second side panel to extend around the bottom of said file folder;

second fastener means for releasably securing an end of said lower belt to said file folder;

an upper belt member secured to said inner surface of said second side panel to extend over said top end of said file folder; and third fastener means for releasably securing said upper belt member to said lower belt member to retain said file folder within said lid section.

5. The attache case of claim 4 wherein said file folder has at least one external pocket covered by said flap when said flap is in said in-use position.

6. The attache case of claim 4 in which said tabs are leather and are stitched to said second side panel along their said edges.

7. The attache case of claim 4 wherein said first and second fastener means each have two parts one of which is permanently mounted on said file folder and hidden by said cover flap in said in-use position.

8. An attache case having a base section formed by a first side panel and four walls arranged in a rectangular configuration, a lid section including a second side panel and having a closed position in which it engages said base section and combines therewith to form a complete box-like enclosure, hinge means for pivotally connecting said lid section to said base section whereby said lid section is movable between said closed position and an open position, latch means for releasably securing said lid section in said closed position, and a removable file folder with a front panel, a back panel, an open top end, a closed bottom end and a cover flap that can be folded over said top end in an in-use position, said file folder being receivable within said lid section with said cover flap in a stored folded-back position between said back panel and said lid section to expose said top edge, wherein the improvement comprises:

securing means for releasably securing said back panel to said lid along said top end thereof with said cover flap in said folded-back position, said securing means comprising at least two flexible tabs each attached along one edge thereof to the inner surface of said second side panel and extending from said one edge over said top end of said file folder toward said hinge; and means for releasably holding said bottom end of said folder against said second side panel.

* * * * *